US007240811B2

(12) United States Patent
Roser

(10) Patent No.: US 7,240,811 B2
(45) Date of Patent: Jul. 10, 2007

(54) LIQUID DISPENSING TAP

(75) Inventor: Philippe Roser, Dossenheim-sur-Zinsel (FR)

(73) Assignee: Flextainer, Schalbach (FR)

( * ) Notice: Subject to any disclaimer, the term of this patent is extended or adjusted under 35 U.S.C. 154(b) by 457 days.

(21) Appl. No.: 10/496,642

(22) PCT Filed: Nov. 25, 2002

(86) PCT No.: PCT/FR02/04037

§ 371 (c)(1),
(2), (4) Date: May 25, 2004

(87) PCT Pub. No.: WO03/045833

PCT Pub. Date: Jun. 5, 2003

(65) Prior Publication Data

US 2004/0256423 A1 Dec. 23, 2004

(30) Foreign Application Priority Data

Nov. 26, 2001 (FR) ..... 01 15274

(51) Int. Cl.
*B67D 3/04* (2006.01)

(52) U.S. Cl. ..... 222/518

(58) Field of Classification Search ..... 222/518
See application file for complete search history.

(56) References Cited

U.S. PATENT DOCUMENTS

| | | | | |
|---|---|---|---|---|
| 3,595,445 | A * | 7/1971 | Buford et al. | 222/213 |
| 4,693,400 | A | 9/1987 | Frahm et al. | |
| 4,706,855 | A * | 11/1987 | Litwin | 222/511 |
| 5,553,745 | A | 9/1996 | McMillian | |
| 6,045,119 | A | 4/2000 | Erb | |
| 6,296,157 | B1 | 10/2001 | Erb | |
| 6,971,553 | B2 * | 12/2005 | Brennan et al. | 222/207 |

* cited by examiner

*Primary Examiner*—J. Casimer Jacyna
(74) *Attorney, Agent, or Firm*—Watson IP Group, PLC; Jovan N. Jovanovic; Vladan M. Vasiljevic

(57) ABSTRACT

A liquid dispensing tap, includes a body for mounting in the bung of a container, a valve or a membrane for sealing an orifice dispensing the liquid, provided with a control member and made in a single-piece therewith and with an element for sealed pressing of the valve or membrane sealing the orifice on its seat, the valve being housed opposite to the part designed to be mounted in the bung, and elements for actuating the control member. The element for sealed pressing of the valve or membrane sealing the orifice on its seat includes an elastically deformable element forming a spring and linked to the valve or membrane sealing the orifice and to the control member via a common guide element and to a fixing flange co-operating with pins fixing and centering the body.

4 Claims, 2 Drawing Sheets

LIQUID DISPENSING TAP

The present invention relates to the field of the production of taps for the distribution of liquids contained in small rigid, semi-rigid or flexible containers, and particularly comestible liquids, and has for its object such a tap.

At present, the distribution of comestible beverages, particularly table wines, fruit juices or milk sterilized at ultra-high temperature in small rigid, semi-rigid or flexible containers, such as containers of synthetic material, usually takes place by means of taps fixed in the outlet bung of these receptacles.

To this end, there are known taps constituted by bodies for mounting in the bung of a receptacle and by a piston for release of the liquid, loaded with a spring and guided in the body, the piston acting a resilient sealing membrane secured to the body. The mounting body in the bung is provided with a securement sleeve connecting snap fittingly with the bung.

Such taps permit correct distribution of the liquid and are perfectly suitable, either for a bottling operation or a series of withdrawals, whether these are latter are carried out in a sterile environment, such as a sterile chamber with a septic filling or not, for example for filling glasses or small receptacles, which is to say for individual use, or in restaurants for small servings of a single beverage or a single vintage.

There are also known taps for liquid distribution, particularly comestible liquids that are aseptic or not, with an automatic closure, which are constituted by a mounting body in the bung of a receptacle and by a piston for releasing the liquid, acting on a resilient sealing membrane secured to the body, these taps being provided with means for holding the piston in an open position.

There also exist other taps of the type with a stopper, in which the passage of the liquid is effected by placing passage openings in registry by means of a lever or a manipulating handle.

All these known taps permit correctly performing their essential function of sealingly closing a receptacle with the possibility of withdrawal of the liquid content.

However, these known taps have the drawback of being of a relatively complicated construction, requiring the use of several pieces, such that their material cost, as well as the cost of assembly, is relatively high. Moreover, the actuation of the piston or the membrane for closing the distribution opening is always carried out by means of intermediate members for transmitting and transforming the movement.

Thus, there is also known from U.S. Pat. No. 4,693,400, a tap for the distribution of liquids constituted by a mounting body in the bung of a receptacle and for distribution of the liquid, by a sealed closure valve from a distribution opening of the liquid, provided with a control member and made in the form of a single piece element with said control member and with a sealed application means for said closure valve sealing the distribution opening for the liquid on its seat, said valve being disposed in the body portion opposite that for mounting in the bung, and by actuating means for said control member.

Similarly, U.S. Pat. Nos. 6,045,119 and 5,553,745 also disclose taps in several pieces.

The present invention has for its object to overcome the drawbacks of the known distribution taps and to provide such a tap having a simpler construction of less costly manufacture.

According to the invention, the liquid distribution tap, which is essentially constituted by a body for mounting in the bung of a receptacle and for distribution of the liquid, by a valve or a membrane for the sealed closure of a distribution opening for the liquid, provided with a control member, is in the form of a single piece element with said control member and with a sealed application means for said valve or sealed closure member of the distribution outlet of the liquid on its seat, said valve or membrane being disposed in the portion of the body opposite that in which is mounted the bung, and by an actuating means for said control member, is characterized in that the sealed application means for the valve or sealed closure membrane for the distribution opening of the liquid on its seat, is constituted by a resiliently deformable member forming a spring and connected on the one hand to the valve or sealed closure membrane for the distribution opening of the liquid and to the control member by means of a common guide element and, on the other hand, with a securement flange coacting with securement and centering lugs on the body.

The invention will be better understood from the following description, which relates to a preferred embodiment, given by way of non-limiting example, and explained with reference to the accompanying schematic drawings, in which.

Figure 1:
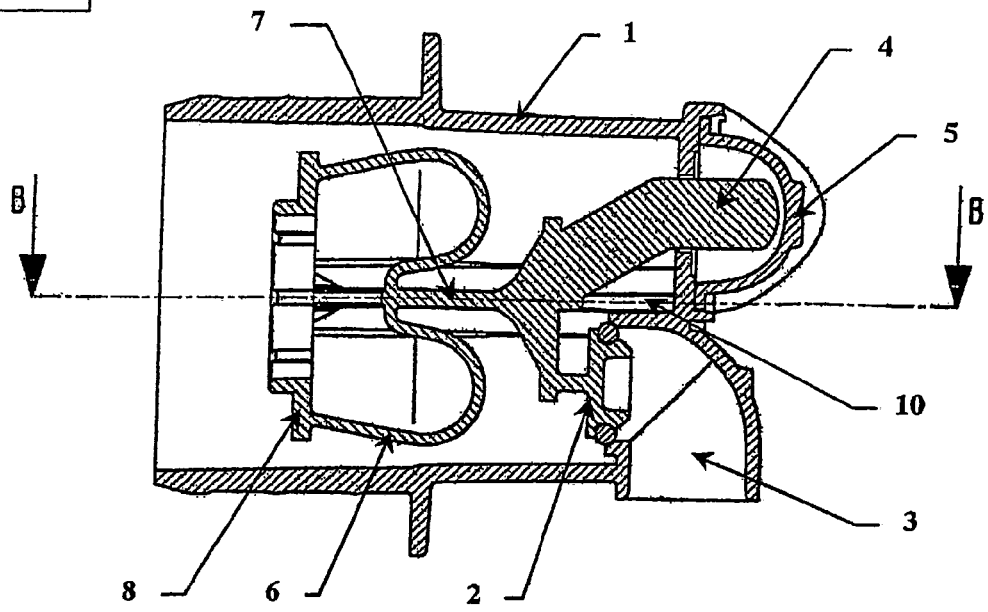
FIG. 1 is a side elevational view in cross-section of the tap according to the invention, in the closed position.

FIGS. 1 to 4 of the accompanying drawings show a tap for the distribution of liquids, which is essentially constituted by a body 1 for mounting in the bung of a receptacle (not shown) and for distribution of the liquid, by a valve or a membrane 2 for sealed closure of an opening 3 for dispensing of the liquid, provided with a control member 4 and made in the form of a single piece element with said control member 4 and with a sealed application means 6 of said valve 2 or membrane for the sealed closure of the opening 3 for distribution of the liquid on its seat, said valve or membrane 2 being disposed in the portion of the body 1 opposite the portion for mounting in the bung, and by a means 5 for actuating said control member 4.

Figure 2:
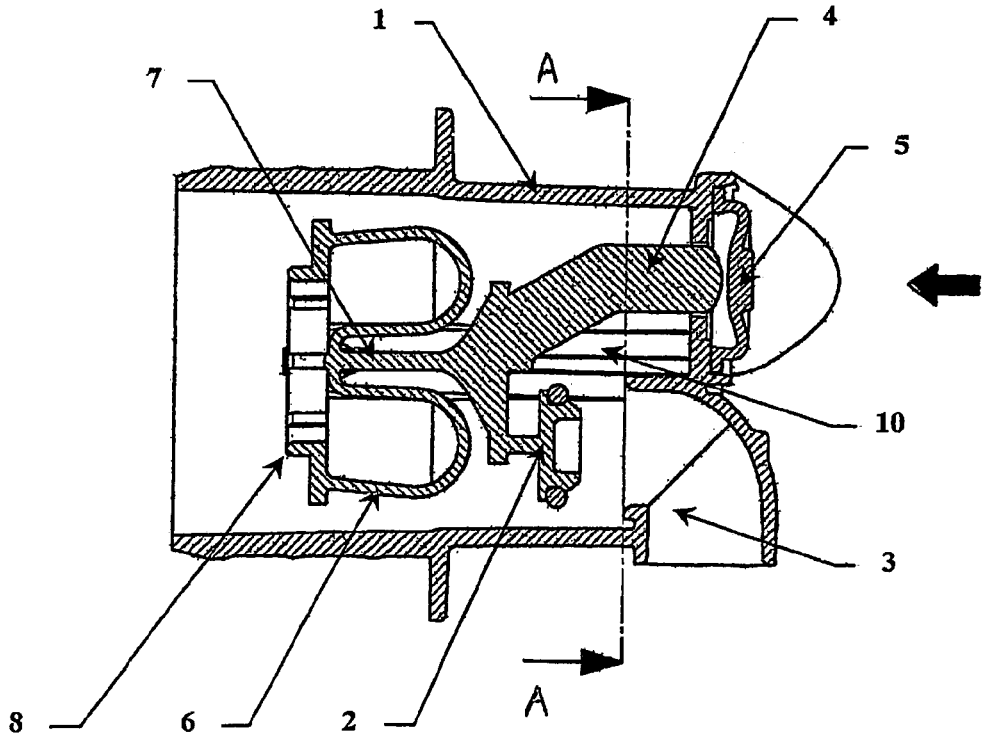
FIG. 2 is a view similar to that of FIG. 1, showing the tap in the open and service position.
Figure 3:
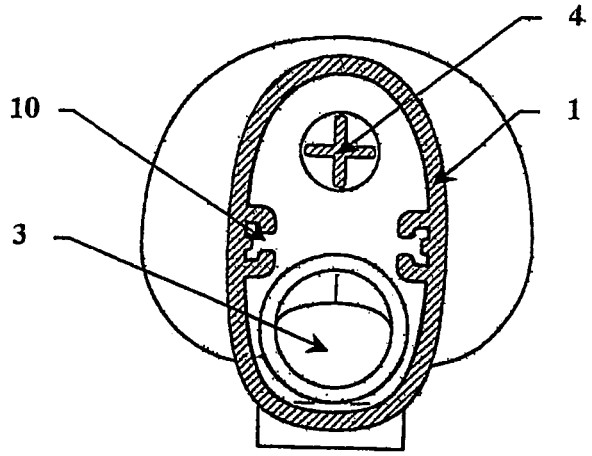
FIG. 3 is a cross-sectional view on the line A—A of FIG. 2, of the tap body alone.
Figure 4:
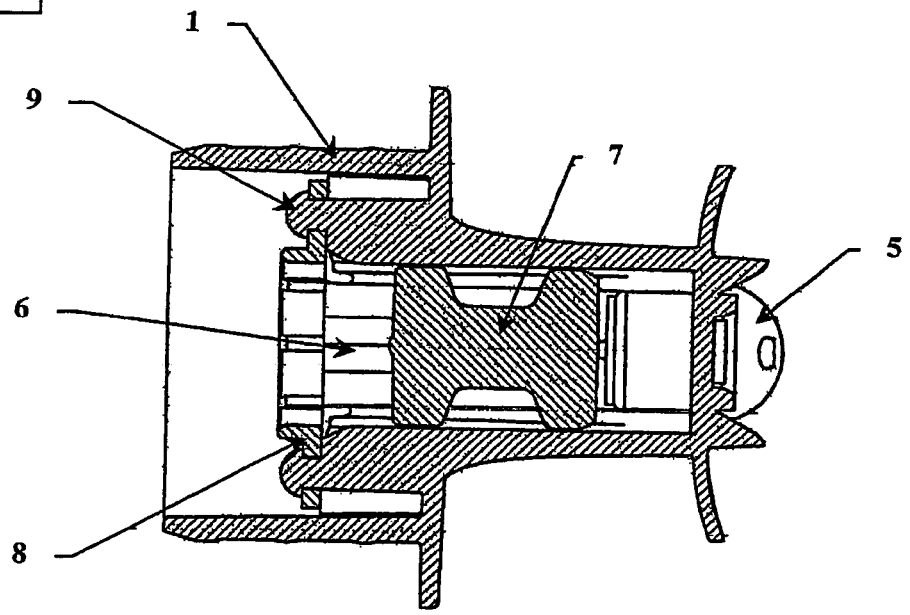
FIG. 4 is a cross-sectional view on the line B—B of FIG. 1.

According to the invention, and as shown more particularly, by way of example, in FIGS. 1 and 2 of the accompanying drawings, the means 6 for sealed application of the valve 2 or membrane for sealed closure of the opening 3 for dispensing of the liquid on its seat is constituted by a resiliently deformable element forming a spring and connected on the one hand to the valve or membrane 2 for sealed closure of the opening 3 for dispensing the liquid and to the control member 4 by means of a common guide element 7 and, on the other hand, to a securement flange 8 coacting with securement and centering lugs 9 of the body 1 (FIG. 4).

The common guide element 7 is in the form of a slide and coacts with two guide rails 10 integral with the body 1 of the tap, which is preferably in the form of a single piece element, at the end opposite that for mounting said body in the bung (FIGS. 1, 2 and 4).

The actuating means 5 for the control member 4 is constituted, as shown in FIGS. 1, 2 and 4 of the accompanying drawings, by a pushbutton in the form of a resiliently deformable membrane provided on the body 1 of the tap and connected to the latter in a sealed manner.

The elastically deformable element 6 forming a spring and constituting the means 6 for sealed application of the valve 2 or membrane for sealed closure of the opening 3 for dispensing the liquid on its seat, is preferably constituted by a pair of resilient blades each connected to an end of the common guide element 7 on the side opposite the connection portion between the control member 4 and the valve or membrane 2 (FIGS. 1, 2 and 5), and at the other end to the securement flange 8 coacting with the securement and centering lugs 9 of the body 1 (FIG. 4), said resilient blades forming a loop between their two ends. Such an embodiment of the means 6 permits, simply because of the construction in the form of blades in a loop, loading the movable elements formed by the control member 4 and the valve or membrane 2, under a predetermined tension in the direction of closing of the opening 3 by the valve or membrane.

Figure 5:
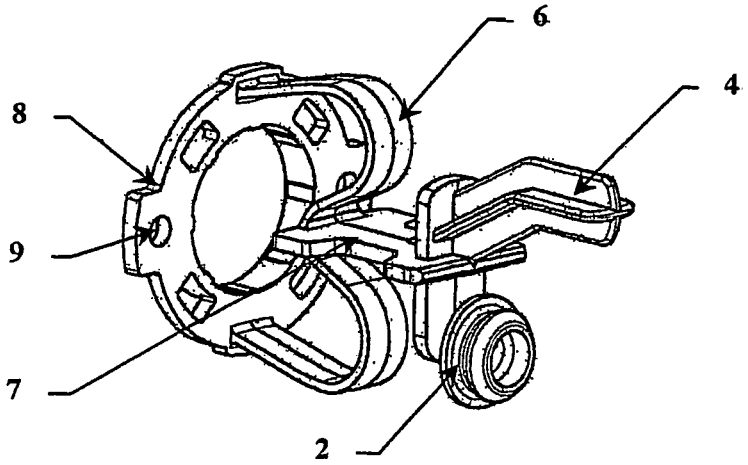
FIG. 5 is a perspective view of the single piece element.

The securement flange 8, connected to the resiliently deformable element 6 forming a spring and constituting the means 6 for sealed application of the valve 2 or membrane for sealed closure of the opening 3 for distribution of the liquid on its seat, is provided with piercings 9' of a shape corresponding to that of the securement and centering lugs 9 and is secured to these latter by riveting or by welding after mounting (FIGS. 4 and 5).

The operation of the tap according to the invention will be clearly seen from FIG. 1, 2, 4 and 5.

Starting with a tap according to FIG. 1, this tap being mounted in a bung of a receptacle, pressing on the pushbutton forming the actuating means 5 for the control member 4 has the effect of moving this latter together with the valve or membrane 2 against the action of the resiliently deformable means 6, by means of the slide forming the common guide element 7. Such a movement is carried out with guidance by co-action of the common guide element 7 with the guide rails 10 integrated into the body 1 (FIGS. 1, 2 and 4).

In the position shown in FIG. 2 of the accompanying drawings, the opening 3 for dispensing the liquid is freed by raising of the valve or membrane 2 from its seat and the liquid contained within the receptacle to which the valve is connected, can flow through said opening 3 for distribution of liquid and can thus be transferred into a consumption receptacle or into an intermediate receptacle before consumption. A relaxation of the pressure on the pushbutton 5 has the immediate effect of returning the control member 4 to its position and also the valve or membrane 2, under the action of the element 6, and hence the closing of the opening 3.

Because of the provision of guide means formed by rails 10 and by the slide formed by the common guide element 7, the assembly of movable elements of the tap is perfectly maintained during its movement.

Thanks to the invention, it is possible to provide a tap for the distribution of liquids contained in small rigid, semi-rigid or flexible containers, in particular comestible liquids, permitting very reliable operation and easy manipulation. Moreover, this tap is of simple construction and requires few pieces to be assembled, such that its production cost is relatively low. Finally, because of the simplicity of its design, this tap can be made in a compact form.

Of course, the invention is not limited to the embodiment described and shown in the accompanying drawings. Modifications remain possible, particularly as to the construction of the various elements or by substitution of technical equivalents, without thereby departing from the scope of protection of the invention.

The invention claimed is:

1. Tap for the distribution of liquids, essentially constituted by a body (1) for mounting in the bung of a receptacle and for distribution of the liquid, by a valve or membrane (2) for sealed closure of an opening (3) for distribution of the liquid, provided with a control member (4) and made in the form of a single piece element with said control member (4) and with a means (6) for sealed application of said valve (2) or member sealingly closing the opening (3) for dispensing the liquid on its seat, said valve being disposed in the portion of the body (1) opposite that for mounting in the bung, and by a means (5) for actuating said control member (4), characterized in that the means (6) for sealed application of the valve (2) or member for sealed closure of the opening (3) for distribution of the liquid on its seat, is constituted by a resiliently deformable element forming a spring and connected on the one hand to the valve or membrane (2) for sealed closure of the opening (3) for distribution of the liquid, and to the control member (4) by means of a common guide element (7) and, on the other hand, to a securement flange (8) co-acting with securement lugs for the centering (9) of the body (1) wherein the common guide element (7) is constituted by a slide and co-acts with two guide rails (10) integrated in the body (1) of the tap, which is in the form of a single piece element, at the end opposite that on which said body is mounted in the bung.

2. Tap for the distribution of liquids, essentially constituted by a body (1) for mounting in the bung of a receptacle and for distribution of the liquid, by a valve or membrane (2) for sealed closure of an opening (3) for distribution of the liquid, provided with a control member (4) and made in the form of a single piece element with said control member (4) and with a means (6) for sealed application of said valve (2) or member sealingly closing the opening (3) for dispensing the liquid on its seat, said valve being disposed in the portion of the body (1) opposite that for mounting in the bung, and by a means (5) for actuating said control member (4), characterized in that the means (6) for sealed application of the valve (2) or member for sealed closure of the opening (3) for distribution of the liquid on its seat, is constituted by a resiliently deformable element forming a spring and connected on the one hand to the valve or membrane (2) for sealed closure of the opening (3) for distribution of the liquid, and to the control member (4) by means of a common guide element (7) and, on the other hand, to a securement flange (8) co-acting with securement lugs for the centering (9) of the body (1) wherein the means (5) for actuating the control member (4) is constituted by a pushbutton in the form of a resiliently deformable membrane provided on the body (1) of the valve and connected to the latter in a sealed manner.

3. Tap for the distribution of liquids, essentially constituted by a body (1) for mounting in the bung of a receptacle and for distribution of the liquid, by a valve or membrane (2) for sealed closure of an opening (3) for distribution of the liquid, provided with a control member (4) and made in the form of a single piece element with said control member (4) and with a means (6) for sealed application of said valve (2) or member sealingly closing the opening (3) for dispensing the liquid on its seat, said valve being disposed in the portion of the body (1) opposite that for mounting in the bung, and by a means (5) for actuating said control member (4), characterized in that the means (6) for sealed application of the valve (2) or member for sealed closure of the opening (3) for distribution of the liquid on its seat, is constituted by a resiliently deformable element forming a spring and connected on the one hand to the valve or membrane (2) for sealed closure of the opening (3) for distribution of the liquid, and to the control member (4) by means of a common guide element (7) and, on the other hand, to a securement flange (8) co-acting with securement lugs for the centering (9) of the body (1) wherein the resiliently deformable element (6) forming a spring and constituting the means (6) for sealed application of the valve (2) or membrane for sealed closing of the opening (3) for dispensing the liquid on its seat is constituted in the form of a pair of resilient blades each connected by one end to the common guide element (7) on the side opposite the connection portion between the control member (4) and the valve or membrane (2), and at the other end of the securement member (8) co-acting with securement and centering lugs (9) on the body (1), said resilient blades forming a loop between their two ends.

4. Tap for the distribution of liquids, essentially constituted by a body (1) for mounting in the bung of a receptacle and for distribution of the liquid, by a valve or membrane (2) for sealed closure of an opening (3) for distribution of the liquid, provided with a control member (4) and made in the form of a single piece element with said control member (4) and with a means (6) for sealed application of said valve (2) or member sealingly closing the opening (3) for dispensing the liquid on its seat, said valve being disposed in the portion of the body (1) opposite that for mounting in the bung, and by a means (5) for actuating said control member (4), characterized in that the means (6) for sealed application of the valve (2), or member for sealed closure of the opening (3) for distribution of the liquid on its seat, is constituted by a resiliently deformable element forming a spring and connected on the one hand to the valve or membrane (2) for sealed closure of the opening (3) for distribution of the liquid, and to the control member (4) by means of a common guide element (7) and, on the other hand, to a securement flange (8) co-acting with securement lugs for the centering (9) of the body (1) wherein the securement flange (8), connected to the resiliently deformable member (6) forming a spring and constituting the means (6) for sealed application of the valve (2) or closure membrane sealed with the opening (3) for dispensing the liquid on its seat, and provided with openings (9') of a shape corresponding to tat of the securement and centering lugs (9) and is secured with these latter by riveting or welding alter mounting.

* * * * *